United States Patent [19]

Rauch et al.

[11] Patent Number: 4,832,763

[45] Date of Patent: May 23, 1989

[54] METHOD OF STRESS-RELIEF ANNEALING A MAGNETIC CORE CONTAINING AMORPHOUS MATERIAL

[75] Inventors: Gary C. Rauch, Colorado Springs, Colo.; Richard E. Kothmann, Churchill Borough, Pa.

[73] Assignee: Westinghouse Electric Corp., Pittsburgh, Pa.

[21] Appl. No.: 787,272

[22] Filed: Oct. 15, 1985

[51] Int. Cl.[4] ..... H01F 1/00

[52] U.S. Cl. ..... 148/121; 148/108; 29/605; 29/609; 29/602.1; 219/10.41; 219/10.57

[58] Field of Search ..... 148/108, 121; 29/602, 29/605, 609; 219/10.41, 10.43, 10.57

[56] References Cited

U.S. PATENT DOCUMENTS

| | | | |
|---|---|---|---|
| 4,262,233 | 4/1981 | Becker et al. | 315/248 |
| 4,298,409 | 11/1981 | DeCristofaro et al. | 148/108 |
| 4,512,924 | 4/1985 | Taub | 148/121 |
| 4,529,177 | 7/1985 | Sheth et al. | 266/274 |

*Primary Examiner*—John P. Sheehan

*Attorney, Agent, or Firm*—B. R. Studebaker

[57] ABSTRACT

A method of stress-relief annealing a magnetic core constructed of magnetic, metallic strip material, with at least a portion of the strip material being amorphous, wherein the strip material has major plane surfaces which define first exposed surfaces of the magnetic core, and lateral edges which collectively define second exposed surfaces of the magnetic core. The method includes the step of thermally insulating the first exposed surfaces of the magnetic core, and the step of heating the magnetic core via the second exposed surfaces.

7 Claims, 5 Drawing Sheets

METHOD OF STRESS-RELIEF ANNEALING A MAGNETIC CORE CONTAINING AMORPHOUS MATERIAL

BACKGROUND OF THE INVENTION

1. Field of the Invention

The invention relates in general to magnetic cores suitable for use in electrical inductive apparatus, such as transformers, and more specifically to new and improved methods of stress-relief annealing magnetic cores.

2. Description of the Prior Art

Magnetic cores constructed of amorphous ferromagnetic strip materials, such as the amorphous alloys available from Allied Corporation, must be stress-relief annealed in order to produce magnetic cores having the lowest core losses and the lowest exciting volt amperes. The effect of the stress-relief anneal is to partially relieve not only the residual stresses from the rapid quenching during production of the amorphous material, but also stresses introduced during core fabrication. A magnetic field applied during the stress-relief anneal process further reduces core losses and exciting volt amperes. However, the stress-relief anneal must be carried out at sufficiently low temperatures and for sufficiently short times to prevent degradation of the magnetic properties by crystallization of the amorphous ferromagnetic material. The resulting time-temperature window defined by the competing thermally-activated processes of stress relief and degradation is quite narrow, so the best magnetic properties are expected in small magnetic cores that can be annealed at essentially uniform temperature.

In large magnetic cores, thermal gradients during heating preclude truly uniform heating at reasonable rates, so that some parts of the magnetic core are expected to be at the stress-relief annealing temperature longer than other parts. The variation in heating rates is made greater by the anisotrophy of thermal conductivity in magnetic cores constructed of amorphous sheet or strip material. Because of the thermal barrier represented by the many gaps between the thin, nominally 1 to 1½ mils, not-perfectly-smooth amorphous sheet layers, the thermal conductivity perpendicular to the plane of the sheet or strip material is very low. As a result, the exposed major sheet surfaces of the magnetic cores and adjacent lamination layers heat up very rapidly, because the heat is not rapidly conducted into the interior of the magnetic core. Although the thermal conductivity of amorphous material is not as high parallel to the sheet plane as that of regular grain oriented electrical steel, such as M-4, it is high enough that surface heat transfer from the furnace atmosphere to the magnetic core appears to be the process controlling the core heating rate, at least under presently used furnace conditions. Consequently, the temperature variation along the sheet plane is not as high as it is perpendicular to the sheet plane, and the layers of the magnetic core experience a different time-temperature history as the heat diffuses inwardly, yielding a nonuniform product from a magnetic viewpoint.

SUMMARY OF THE INVENTION

Briefly, the present invention is a new and improved method of stress-relief annealing a magnetic core constructed of magnetic, metallic strip material, with at least a portion of the magnetic core containing amorphous ferromagnetic sheet or strip material. The method includes the step of thermally insulating the exposed surfaces of the magnetic core which are defined by major sheet surfaces of the strip material, while heating the magnetic core in an oven or furnace. This prevents the exposed major sheet surfaces and adjacent lamination layers of the magnetic core from reaching stress-relief temperature long before the center of the core structure. The exposed surfaces of the magnetic core which are defined by closely adjacent lateral edges of the strip material are not thermally insulated so that most of the heat reaching the center of the magnetic core arrives there by conduction along the sheet plane after entering the magnetic core at the strip edges.

The invention prevents the exposed outer layers of laminations of the magnetic core defined by the major sheet surfaces of the strip from residing at high temperature much longer than the remainder of the core. The invention thus prevents excessive embrittlement and degradation of the normally low core loss characteristics which excessive holding time at stress-relief anneal temperature can cause. Further, these desirable features are achieved with a substantially shorter stress-relief anneal cycle time, increasing productivity and reducing manufacturing costs, including the cost of capital equipment. Instead of the furnace temperature approaching the stress-relief anneal temperature $T_{SRA}$ from below, in steps, the furnace temperature, with magnetic cores and/or core parts in the furnace, is increased from ambient to a temperature substantially above the stress-relief anneal core temperature. The temperature of a magnetic core, such as the geometric center of a core limb, may be directly monitored with thermocouples. Or, after the thermal profile for a known furnace load of magnetic cores and/or core parts has been established by the use of thermocouples, the use of thermocouples may be dispensed with by duplicating a learned time-temperature furnace cycle. When the furnace load reaches the desired stress-relief anneal temperature $T_{SRA}$ the furnace temperature is dropped to $T_{SRA}$ for a predetermined holding or soaking time. At the end of the soaking period, energy input to the furnace is terminated and the furnace is allowed to cool. The magnetic cores and/or core parts are maintained in the furnace, at least until the temperature of the furnace load falls to a predetermined value.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which.

DESCRIPTION OF THE PREFERRED EMBODIMENT

Figure 1:
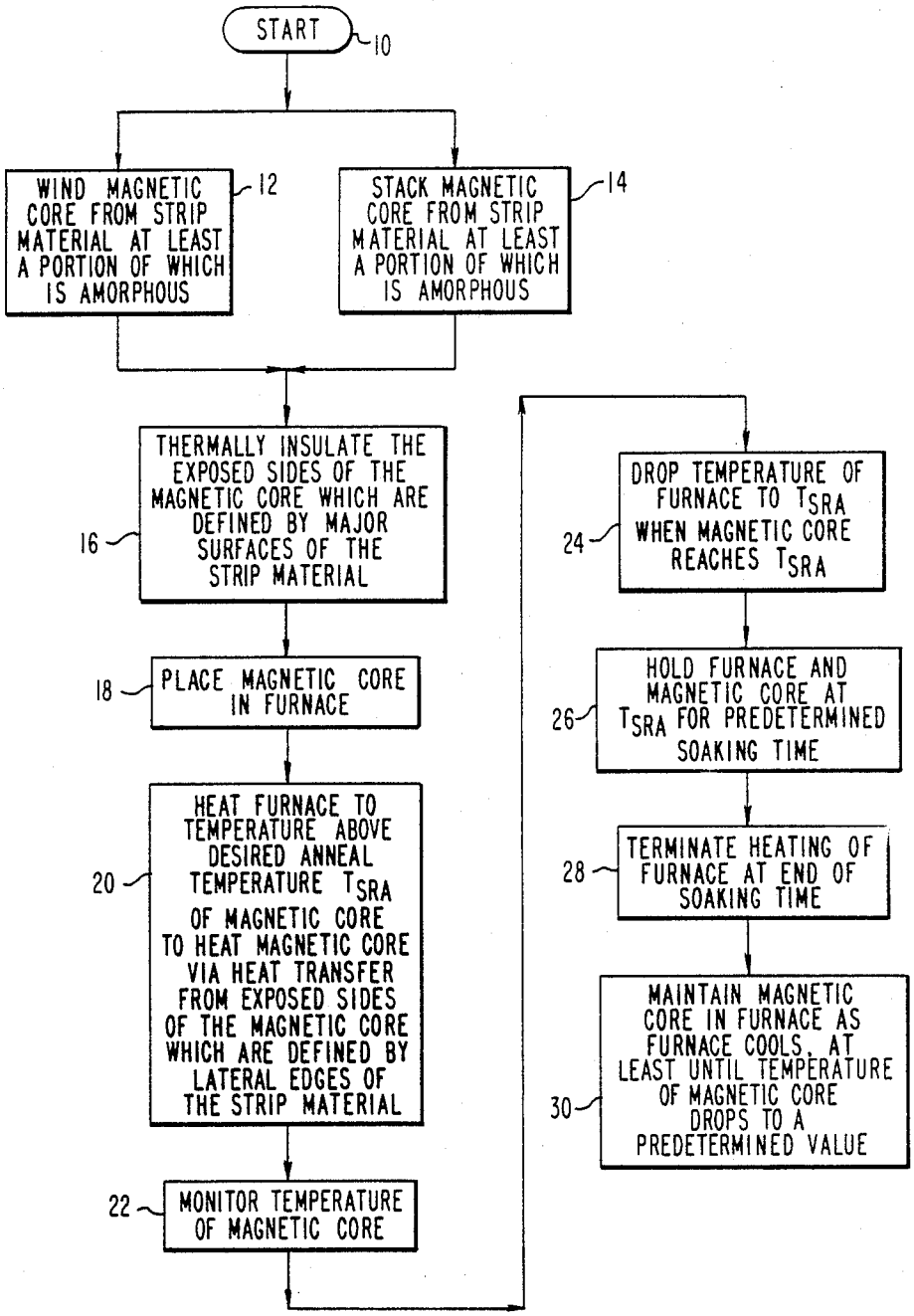
FIG. 1 is a block diagram outlining the steps of stress-relief annealing a magnetic core which contains amorphous strip material, according to the teachings of the invention.

Referring now to the drawings, FIG. 1 is a block diagram setting forth the steps of a new and improved method of stress-relief annealing a magnetic core according to the teachings of the invention, wherein at least a portion of the magnetic core includes magnetically soft, ferromagnetic amorphous steel alloy. For purposes of example, the invention will be described using Allied Corporation's Metglas® alloy 2605S-2 as the amorphous material, but other soft ferromagnetic amorphous alloys may be used. For purposes of example, the invention will be described relative to complete core loops. However, it is to be understood that the invention is equally applicable to the stress-relief anneal of parts of magnetic cores. For example, stacks of laminations may be stress-relief annealed according to the teachings of the invention, which stacks are subsequently utilized in leg and yoke portions of stacked-type cores, or which are later cured to form a jointed wound core. The term "core member" is intended to include a complete magnetic core, a corelet or part core, and parts of a magnetic core. The method starts at entry point 10 and proceeds to step 12 or step 14, depending upon whether the magnetic core is of the wound type or of the stacked type. If the magnetic core being constructed is of the wound type, step 12 winds the magnetic core from strip material. The resulting wound core loop may be used, uncut, or it may be cut to form any desired type of joint. The wound-type core may also be wound from a plurality of strips whose lengths establish a desired joint configuration. The entire magnetic core may be constructed of amorphous strip material, or only a predetermined portion of the magnetic core may be formed of amorphous strip material, with the remainder being formed of a nonamorphous strip material, such as regular grain oriented electrical steel. For example, a few of the innermost and/or outermost lamination turns may be formed of regular grain oriented electrical steel in order to protect the relatively brittle amorphous material. U.S. Pat. No. 4,520,335, which is assigned to the same assignee as the present application, discloses mixing amorphous and grainoriented electrical steel in order to provide a transformer core which may be operated at a higher induction than the saturation limited induction of the amorphous material. Any stress-relief anneal of the non-amorphous material in the wound core would be performed prior to assembly with the amorphous material, because the stress-relief anneal temperature for regular grain oriented electrical steels, typically 800° C. to 900° C., is well above the crystallization temperature $T_X$ of amorphous alloys, which is 550° C. for the hereinbefore mentioned 2605S-2 alloy. In order to simplify the subsequent description of typical magnetic cores, it will be assumed that the entire magnetic core is constructed with amorphous material, as the method of stress-relief annealing according to the teachings of the invention is the same for 100% amorphous cores as it is for "mixed" cores.

Figure 2:
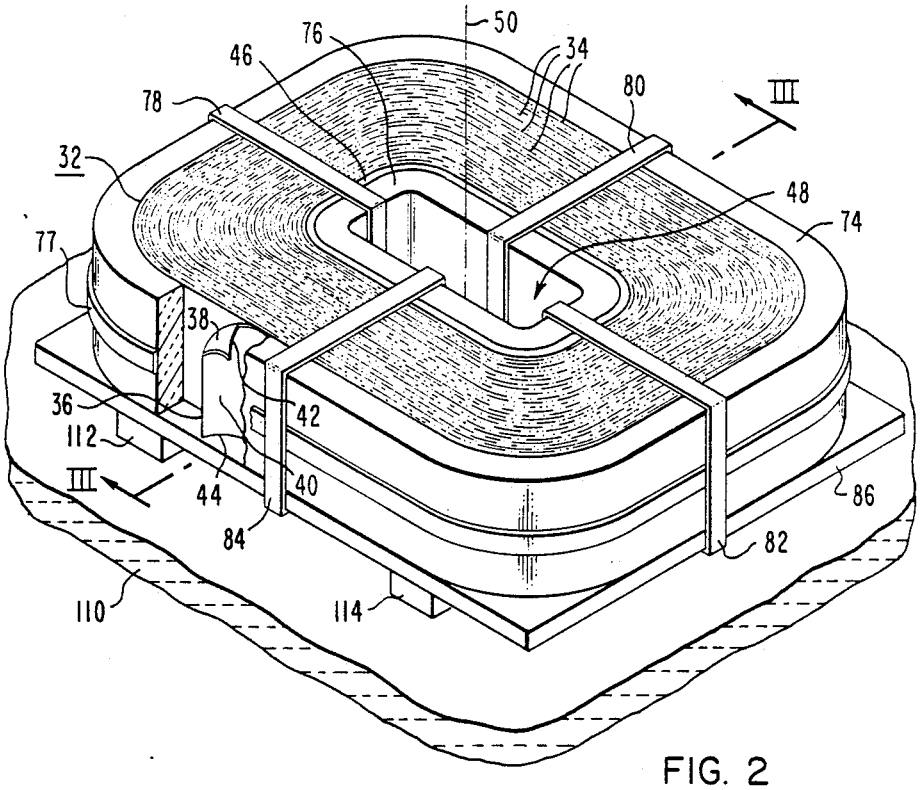
FIG. 2 is a perspective view of a magnetic core of the wound type thermally insulated according to the teachings of the invention.

FIG. 2 is a perspective view of a wound-type magnetic core 32 which may be constructed according to step 12. Magnetic core 32 includes a plurality of susperposed, tightly nested, magnetic, metallic lamination turns 34, with FIG. 3 being a cross-sectional view of magnetic core 32 taken between and in the direction of arrows III—III in FIG. 2. A strip 36 of amorphous material having first and second flat, major opposed sides or surfaces 38 and 40 bounded by lateral edges 43 and 44 may be wound about a mandrel 46, until the desired core build dimension is achieved. Mandrel 46 may have a rectangular cross-section, as illustrated in FIG. 2, or a circular cross-section, as desired, depending upon the whether the type of transformer being constructed is rectangular or toroidal. Mandrel 46 defines a core opening or window 48 having an axis 50.

If the magnetic core being constructed is of the stacked type, step 14 cuts laminations from strip material and stacks the laminations to construct the magnetic core. As stated relative to the wound core in step 12, the stacked core may be 100% amorphous, or amorphous mixed with non-amorphous material, such as regular grain oriented electrical steel.

Figure 4:
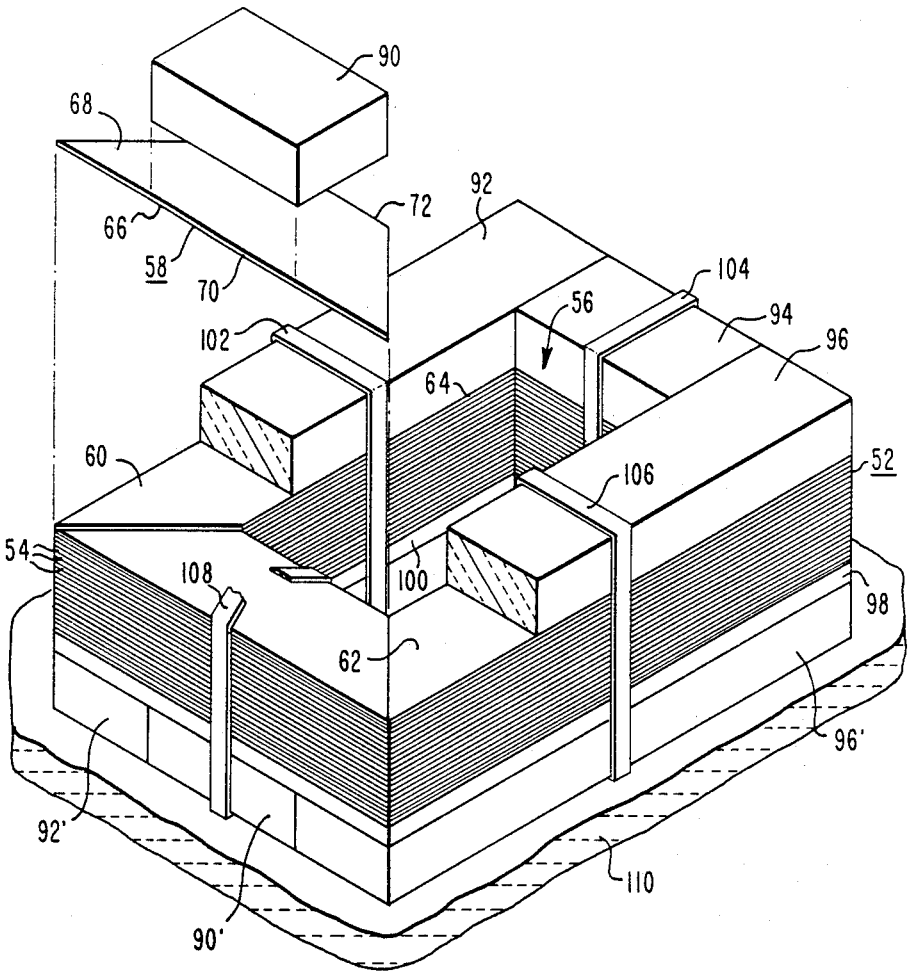
FIG. 4 is a perspective view of a magnetic core of the stacked type thermally insulated according to the teachings of the invention.

FIG. 4 is a perspective view of a stacked type magnetic core 52 which may be constructed to satisfy step 14. The magnetic core 52 includes a plurality of superposed lamination layers 54, with each layer 54 being constructed of a plurality of flat, magnetic, metallic laminations arranged to form a closed magnetic path while defining an opening or window 56. For example, the uppermost layer 54 may include a lower yoke lamination 58, leg laminations 60 and 62, and an upper yoke lamination 64. Each lamination, such as lamination 58, is formed from one or more strips of amorphous material. Lamination 58, if formed from a single strip, has first and second major flat opposed sides or surfaces 66 and 68 bounded by first and second lateral edges 70 and 72. In order to aid handling and stacking of the amorphous strip material, lamination 58 may be constructed from a plurality of strips of amorphous material bonded together so that they may be easily handled. If the desired width of the laminations is greater than the available amorphous strip width dimension, the width of the lamination may be increased to the desired dimension by using different width strips placed side-by-side, bonded to adjacent layers of side-by-side strips, placed such that the joints of each layer are offset from layer to layer.

After constructing a magnetic core member in step 12 or step 13, it will be noted that first and second external or exposed surfaces of the resulting magnetic core member are defined by the major plane surfaces or sides of the strip material, and the remaining or third and fourth core surfaces are each defined by a plurality of lateral strip edges disposed in closely adjacent side-by-side relation. In the wound core 32 shown in FIGS. 2 and 3, the first and second exposed surfaces of those defined by the major surfaces of the innermost and outermost lamination turns, and the third and fourth exposed surfaces are those at the axial ends of the magnetic core collectively defined by lamination edges, i.e., the flat, horizontally oriented surfaces, with respect to the orientation of magnetic core 32 shown in FIGS. 2 and 3. In the stacked core 52 shown in FIG. 4, the first and second exposed surfaces are at the axial ends of the core, being those defined by the two outermost layers of laminations, i.e., the bottom and top layers in the orientation of magnetic core 52 shown in FIG. 4. The third and fourth exposed surfaces are the vertically oriented surfaces which define the outer periphery of the magnetic core and the vertically oriented surfaces which define the core window 56.

Step 16 thermally insulates the first and second exposed surfaces of the magnetic core member, i.e., those defined by the major sides or surfaces of the strip material, so that when the magnetic core is subsequently heated, most of the heat will enter the core via the lamination edges, which is referred to as the third and fourth exposed surfaces of the magnetic core.

Any thermal insulation which will withstand the stress-relief anneal temperature without oxidizing or otherwise deleteriously decomposing, and which may be easily handled and secured to the requisite surfaces of the magnetic core, may be used. For example, Fiberfrax Durablanket S availabale from the Caraborundum Company is suitable. In the wound core application shown in FIGS. 2 and 3, first and second strips 74 and 76 of thermal insulation are cut to length and strip 74 is wrapped about the outermost lamination turn and strip 76 is placed in core window 48 and pressed against the inner surface of mandrel 46. High temperature tape or wire, such as a polyimide tape, may be used to secure insulation strips 74 and 76 in the desired locations, such as indicated by circumferential tape wrap 77, and radial tape wraps 78, 80, 82 and 84. Magnetic core 32 is preferably supported on a flat plate member 86 having a central opening 88 during the stress-relief anneal cycle, and the tape wraps 78, 80, 82 and 84 may encircle plate member 86 as well as the limbs of magnetic core 32, as illustrated. Since according to the invention, the lamination edges adjacent to plate member 86 are to be heated, plate member 86 should be constructed of a material which will provide that result. For example, a solid metal plate, or other material having a good thermal conductivity may be used, or a foraminous material may be used which is sufficiently porous to enable the furnace atmosphere to contact the lamination edges.

In the stacked core application shown in FIG. 4, four strips 90, 92, 94 and 96 of thermal insulation are cut to length for application against the leg and yoke laminations of the uppermost lamination layer. Similar strips are cut for the bottom lamination layer. Bottom strips which correspond to the top strips of insulation are referred by the same reference number except for the addition of a prime mark. Magnetic core 52 is supported by a plate member 98 having an opening 100 in registry with core window 56, with the thermal strips for the bottom lamination layer being placed against the metallic plate. Similar to the wound core embodiment, tape, wire, or other suitable means may be used to secure the thermal insulation against the major surfaces of the exposed laminations, such as tape wraps 102, 104, 106 and 108.

Figure 3:
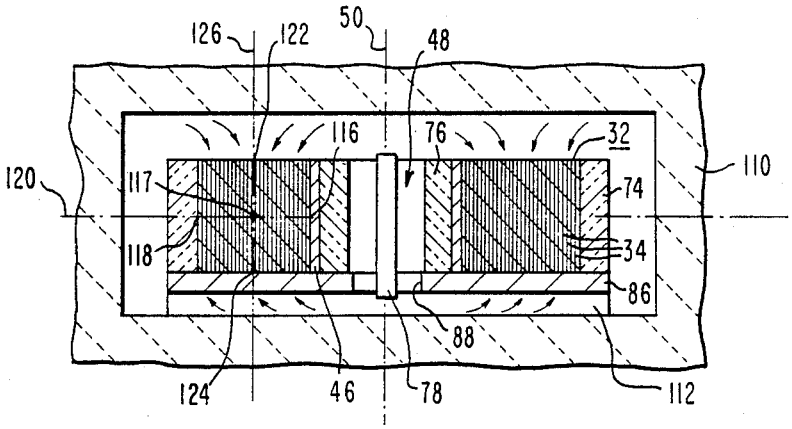
FIG. 3 is a cross-sectional view of the magnetic core shown in FIG. 2, taken between and in the direction of arrows III—III in FIG. 2.

After the first and second exposed surfaces of magnetic cores 32 and 52 are thermally insulated, the next step of the method, step 18 in FIG. 1, is to place the thermally insulated magnetic core in an oven or furnace, such as the furnace 110 shown partially cut away in FIGS. 2, 3 and 4. The stress-relief anneal cycle must be carried out in an inert, non-oxidizing atmosphere, such as nitrogen, argon, or helium. The furnace may be a batch type furnace or a properly zoned and atmospherically controlled continuous furnace, depending upon production requirements. For purposes of example, it will be assumed that the furnace is a batch furnace sized to handle a predetermined number of magnetic cores and/or core parts. A thermocouple may be placed between predetermined laminations of the magnetic core to measure the actual temperature at the geometric center of a limb of the magnetic core, and not the furnace temperature. The furnace temperature is separately monitored. Both the wound and stacked type cores 32 and 52, respectively, are illustrated in the Figures as being stress-relief annealed with the axes of the core windows oriented perpendicular to the bottom or floor of the furnace. While this would be the usual orientation, orientation is not important as long as the magnetic cores are properly supported to minimize distortion. Plate member 86, which supports the wound core 32, should be spaced from the bottom of the furnace 110, such as via members 112 and 114, in order for the atmosphere in the furnace to circulate past the bottom surface of the plate 86. The magnetic cores in furnace 110 must be adequately spaced from any furnace heating elements, in order to prevent localized hot spots or over-annealing.

After the magnetic cores are placed in furnace 110, with the inert atmosphere applied, the furnace is energized, as set forth in step 20 of FIG. 1. With the first and second major sides or surfaces of the magnetic material thermally insulated from the furnace atmosphere, the temperature of the furnace atmosphere may be elevated to a value substantially above the desired stress-relief anneal temperature $T_{SRA}$ of the magnetic core. With the hereinbefore mentioned 2605S-2 amorphous alloy, which has a crystallization temperature $T_X$ of 550° C. and a desired stress-relief anneal temperature of about 380° C., the furnace atmosphere itself is raised to a temperature above 380° C., with 400° C. to 500° C. being a preferred range. With a wound, rectangular magnetic core, such as shown in FIGS. 2 and 3, having about 2,600 lamination turns and weighing about 120 pounds, a furnace temperature of 410° C. has been found to be excellent, but higher furnace temperatures may be used without overheating the lamination edges, and without excessive thermal gradients across the core, with the actual furnace temperature depending upon core size and geometry. The annealing time-temperature relationship of the core itself for the amorphous material involved is the important criterion. Thus, as long as the amorphous material does not reach its crystallization temperature $T_X$, the selected temperature for the furnace atmosphere is not critical.

Figure 5:
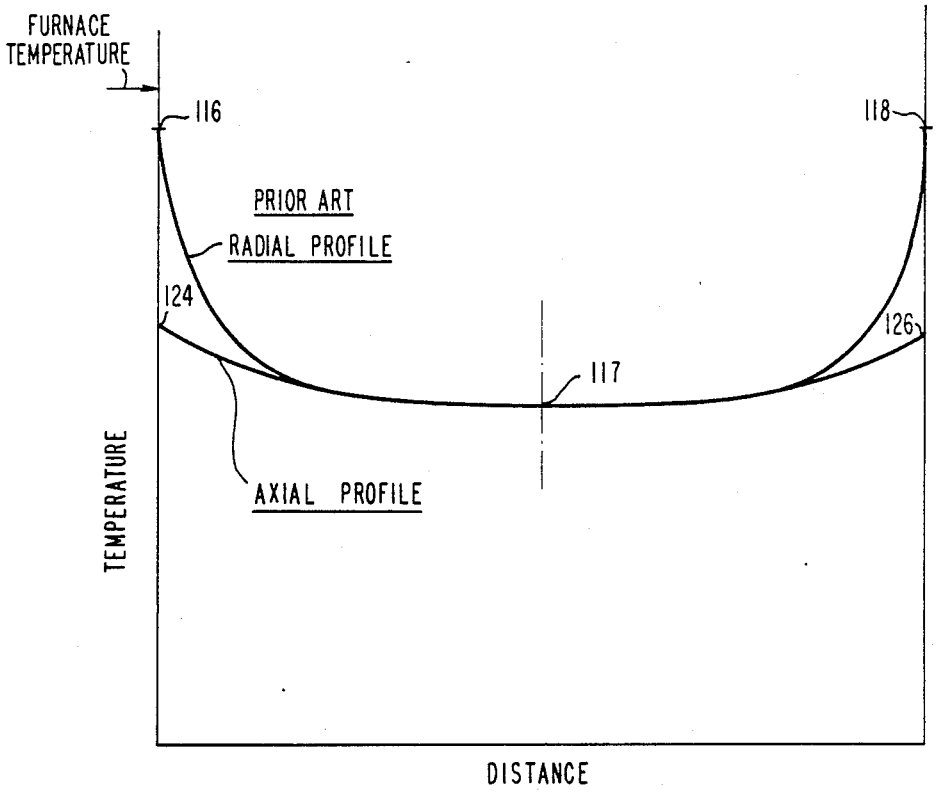
FIG. 5 is a graph illustrating radial and axial temperature profiles across a magnetic core stress-relief annealed without thermal insulation, at a point during the stress-relief anneal heating cycle.

FIG. 5 is a graph which illustrates how the temperature of a magnetic core increases when heated in a furnace without the thermal insulation applied to the major surfaces of the exposed laminations. Using the cross-sectional view of magnetic core 32 shown in FIG. 3 as an example, the radial temperature profile shown in FIG. 5 extends from the center 116 of the innermost lamination turn, through the geometric center 117 of the core limb, to the center 118 of the outermost lamination turn across a section of the core 32 where a centerline 120 axially divides core 32 into two equal halves. The axial temperature profile shown in FIG. 5 extends from the center 122 of the core build dimension on the flat, horizontally oriented, upwardly facing surface of core 32, through the geometric center 117 of the core limb, to the center 124 of the core build dimension on the flat, horizontally oriented, downwardly facing surface of core 32, where a vertical centerline 126 crosses the external surfaces. The present invention eliminates the widely varying radial profile shown in FIG. 5, and brings the core temperature up along the axial profile, which exhibits very little non-uniformity in temperature across the magnetic core. Thus, the furnace temperature may be substantially above the maximum desired core temperature, without danger of over-annealing, without unduly embrittling the amorphous material, and without crystallizing the amorphous material.

Step 22 monitors the temperature of the magnetic cores in the furnace 110. As hereinbefore stated, this may be accomplished by placing a thermocouple at point 117, i.e., the geometric center of a core limb, or by a previously learned time-temperature furnace cycle. When the temperature of the furnace load reaches the desired stress-relief anneal temperature $T_{SRA}$, step 24 drops the temperature of the furnace to $T_{SRA}$. Thus, in the example of the 2605S-2 amorphous alloy, the furnace temperature would be dropped from 410° C. to 380° C. when the temperature of the furnace load reaches 380° C. In the example of the 120 pound core, the time from furnace energization to the time when the furnace temperature is dropped to the temperature of the furnace load is between four and five hours.

Step 26 then holds the furnace and magnetic cores at the $T_{SRA}$ temperature for a predetermined holding or soaking time, such as two hours, for example.

Energy input to the furnace is terminated at the end of the soaking time, as set forth in step 28. As indicated in step 30, the magnetic cores are maintained in the furnace as the furnace cools, at least until the temperature of the magnetic cores drops to a predetermined value, such as 200° C. The cores may then be removed from the furnace and the thermal insulation removed. With the 120 pound cores hereinbefore mentioned, the cooling time is between four and five hours. A magnetic field may be applied to each magnetic core during the stress-relief anneal cycle, if desired, such as during the cool-down period.

Figure 7:
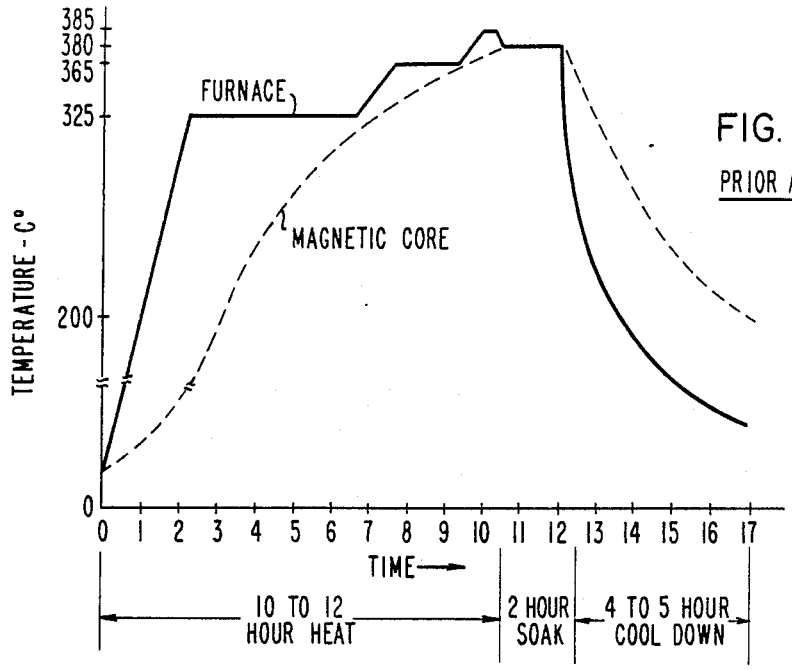
FIG. 7 PRIOR ART
FIG. 7 is a graph illustrating a typical stepped stress-relief anneal cycle of the prior art for a magnetic core containing amorphous material.
Figure 6:
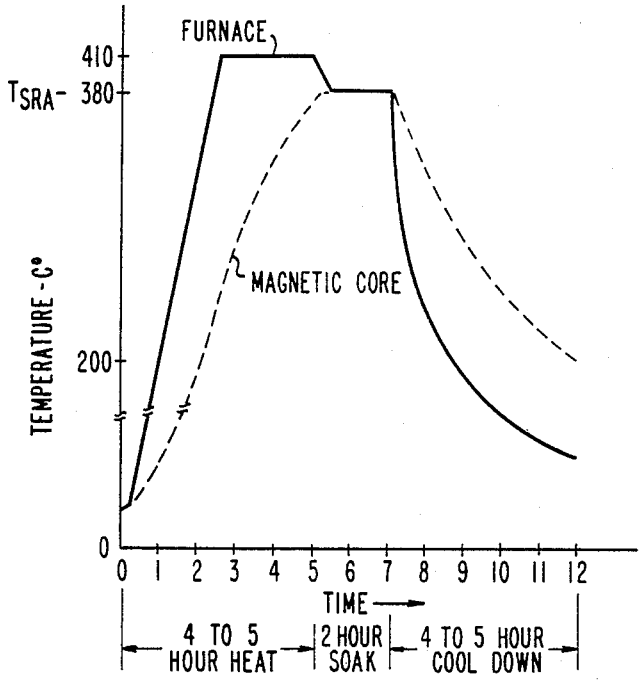
FIG. 6 is a graph illustrating a typical stress-relief annealing cycle for stress-relief annealing a magnetic core containing amorphous material, according to the teachings of the invention.

FIG. 6 is a graph which sets forth the stress-relief anneal cycle for the 120 pound magnetic core of the example, wherein the core is constructed of the 2605S-2 amorphous alloy. The complete cycle time is between 10 and 12 hours. The same magnetic core constructed of the same amorphous material except stress-relief annealed without thermal insulation on the first exposed surfaces would require a step anneal cycle as set forth in the graph shown in FIG. 7. In addition to a much longer overall heat treating cycle, the lamination turns would be subjected to greater gradients and significantly different time-temperature histories which may result in a non-uniform product which increases the true watt (TW) core losses, as well as the exciting volt amperes or apparent watt loss (AW). For example a typical cycle of the prior art would raise the furnace temperature to 325° C. When the temperature of the furnace load catches up to the furnace temperature, the furnace temperature is then raised to 365° C. When the temperature of the furnace load again catches up, the furnace temperature is then raised to 385° C. When the temperature of the furnace load reaches 380° C., the furnace temperature is dropped to 380° C. for the two hour soaking period. It takes between ten and twelve hours to bring the magnetic core temperature to 380° C., as opposed to the four to five hours required for the identical magnetic core when processed according to the teachings of the invention. Thus, less furnace capacity is required, for the same production rate, energy costs are lower, the amorphous metal is less brittle, and the amorphous material is excellent magnetically.

We claim as our invention:

1. A method of stress-relief annealing a magnetic core, or part of a magnetic core, comprising the steps of:

constructing a magnetic core member having a plurality of superposed laminations from magnetic, metallic strip material, with at least certain of the magnetic strip material being amorphous, and wherein the strip material has major plane surfaces bounded by first and second lateral edges, to provide a core member having first and second exposed major surfaces defined by major plane surfaces of the strip material and third and fourth exposed surfaces each collectively defined by a plurality of closely adjacent first and second lateral edges, respectively, of the strip material, applying a supply of heat to both the third and fourth exposed surfaces of the core member simultaneously, while keeping the first and second exposed major surfaces of said core member thermally insulated from the supply of heat by the step of applying removable thermal insulating material to the first and second exposed major surfaces, to heat the core member primarily by heat conduction along the sheet plane after entering the core member from both the first and second lateral edges of the strip material, and providing an inert, non-oxidizing atmosphere about said core member, during the step of applying heat thereto.

2. The method of claim 1 wherein the amorphous material has a desired stress-relief anneal temperature $T_{SRA}$, and wherein the step of applying heat to the core member includes the steps of:

placing the core member in a furnace, heating the furnace to a predetermined temperature higher than $T_{SRA}$, monitoring the temperature of the core member, and dropping the temperature of the furnace to $T_{SRA}$ when the temperature of the core member reaches $T_{SRA}$.

3. The method of claim 2 including the steps of:

holding the temperature of the furnace and core member at $T_{SRA}$ for a predetermined soaking time, terminating the heating of the furnace at the end of the soaking time, and maintaining the core member in the furnace as the furnace cools, at least until the temperature of the core member drops to a predetermined value.

4. The method of claim 1 wherein the step of constructing the core member includes the step of:

winding magnetic, metallic strip material to provide a plurality of superposed lamination turns which encircle and define a core window, with the first and second exposed surfaces which are thermally insulated by the insulating step being the major plane surfaces of the strip material which respectively define the innermost and outermost lamination turns.

5. The method of claim 4 wherein the step of winding the strip material includes the step of providing support means in the core window with the innermost lamination turn being thermally insulated by applying thermal insulation to the support means.

6. The method of claim 1 wherein the step of constructing the magnetic core member includes the step of:

stacking strips of magnetic, metallic strip material to provide a plurality of superposed lamination layers with the first and second exposed surfaces which are thermally insulated by the insulating step being the major plane surfaces of the outermost lamination layers on opposite sides of the magnetic core member.

7. The method of claim 6 wherein each lamination layer includes leg and yoke laminations assembled to define a closed magnetic path about a core window.

* * * * *